United States Patent [19]

Moser

[11] 4,078,865

[45] Mar. 14, 1978

[54] LIQUID APPLICATOR

[76] Inventor: Robert J. Moser, 138-06 35th Ave., Flushing, N.Y. 11354

[21] Appl. No.: 721,189

[22] Filed: Sep. 8, 1976

[51] Int. Cl.[2] ..... A47L 1/08; A47L 13/12

[52] U.S. Cl. ..... 401/23; 401/140; 401/202; 401/207; 15/118

[58] Field of Search ..... 401/37, 23, 42, 52, 401/98, 140, 184, 196, 202, 207, 123, 124, 38; 15/118

[56] References Cited

U.S. PATENT DOCUMENTS

| | | | |
|---|---|---|---|
| 2,746,461 | 5/1956 | Bocchino | 15/118 |
| 3,124,828 | 3/1964 | Barber et al. | 401/202 |
| 3,128,493 | 4/1964 | Paul | 401/184 |
| 3,455,638 | 7/1969 | Braswell | 401/23 |
| 3,837,747 | 9/1974 | Seymore | 401/25 |

*Primary Examiner*—Stephen C. Pellegrino

[57] ABSTRACT

A liquid applicator that includes an applicator member for receiving a liquid to be applied, an elongated delivery member therefor, a cover including a removable scraping member and an entry part for engaging a container having the liquid to be applied.

5 Claims, 3 Drawing Figures

LIQUID APPLICATOR

BACKGROUND OF THE INVENTION

This invention relates to a liquid applicator; more particularly to an applicator for delivery of a liquid at a distance from the liquid container. The applicator is especially useful in delivering a liquid to hard to reach areas of the human body.

The prior art teaches a variety of liquid applicators, for example, as disclosed in U.S. Pat. Nos. 2,820,234; 2,893,607; 2,919,455; 2,976,560; 3,455,638; 3,637,141; 3,922,099; 3,938,898; and others.

SUMMARY OF THE INVENTION

It is accordingly an object of the instant invention to provide for a new and improved liquid applicator.

It is another object to provide for one that additionally enjoys a cover portion and a scraping member thereon.

It is a further object to provide for the same at relatively little cost thereby making it generally available.

These and other objects and advantages of the invention will become more apparent from a consideration of the following detailed disclosure and claims and by reference to the accompanying drawings, in which:

Figure 1:
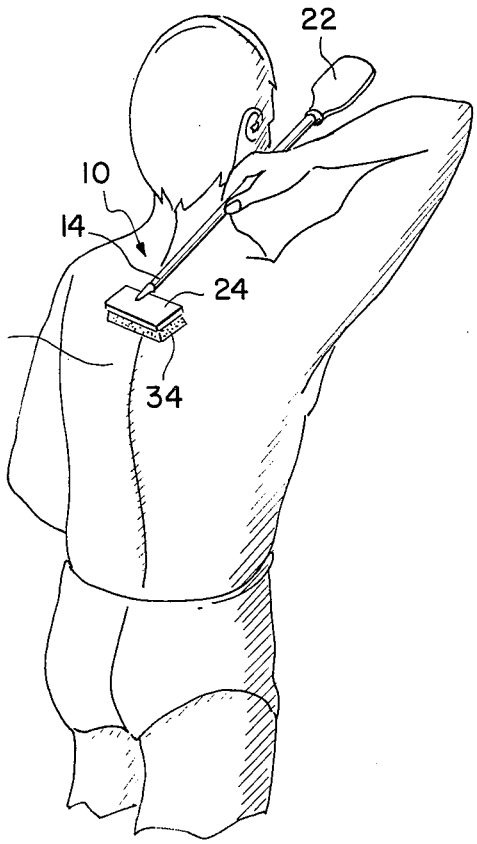
FIG. 1 is a perspective view of the device in application.
Figure 2:
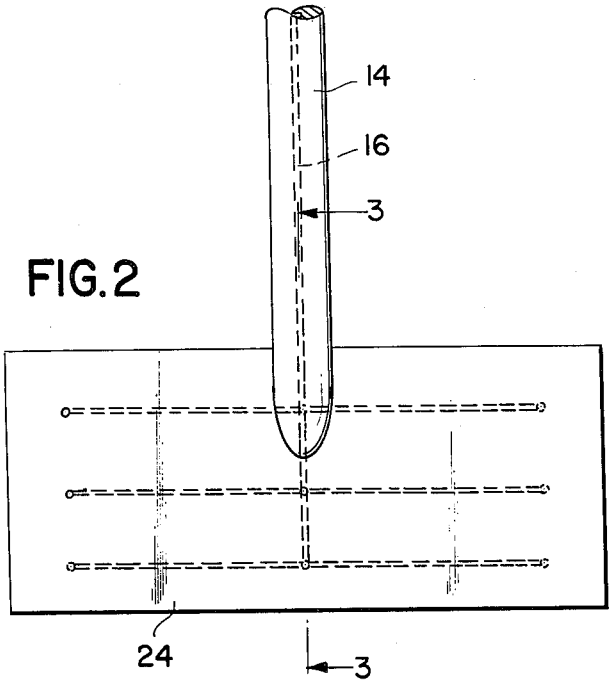
FIG. 2 is a front elevational view of one end of the device.
Figure 3:
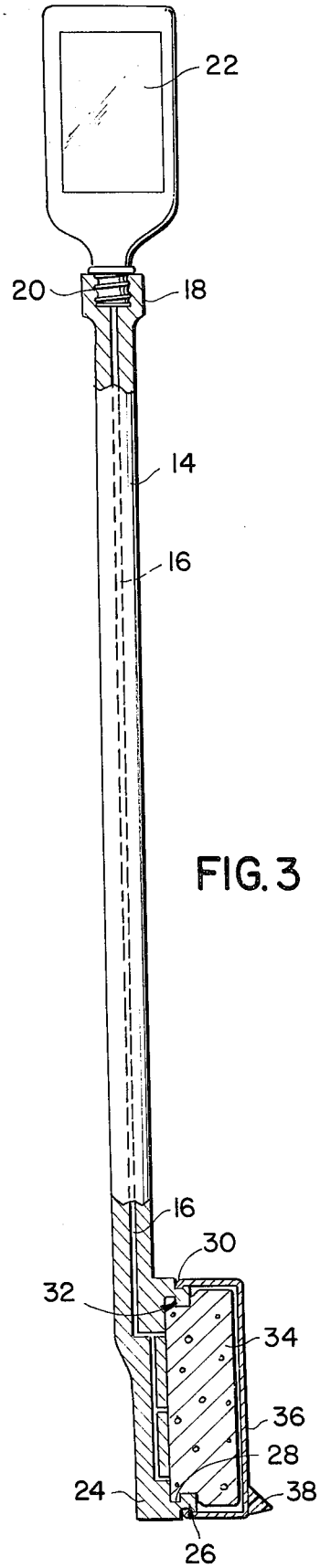
FIG. 3 is a sectional view taken along the line 3—3 of FIG. 2.

Broadly speaking, the instant invention includes the provision of a liquid applicator for use in combination with a container having an externally threaded mouth portion and a quantity of liquid therein, comprising an elongated tubular member having a central main bore disposed therein in longitudinal alignment therewith, one distal end of the tubular member forming a portion of enlarged size relative to the same and being disposed transverse the longitudinal axis thereof, the portion including a plurality of minor bores therein, the minor bores communicating with and being substantially perpendicular to the main bore, the portion including a pair of winged projections along two opposing sides of the portion, a porous member for receiving and retaining a quantity of liquid for subsequent application disposed along the surface of the portion, the member communicating with and being substantially perpendicular to the minor bores, the opposite distal end of the tubular member having an open mouth defining a plurality of internally disposed threads adjacent thereof, the internally disposed threads adapted to mate with the threads on the container.

DETAILED DISCLOSURE

Referring more particularly to the drawings, there is shown a liquid applicator 10 and its application to a substrate 12 such as the back of the human body. The instant device 10 includes an elongated hollow tubular delivery member 14 that defines a central bore 16 of constructed diameter relative to the member 14, i.e., ¼–1/7 the diameter of the member 14. One distal end 18 of the member 14 forms an enlarged mouth or port having an external diameter greater than that of the body of the member 14 and being internally threaded 20 thereby being adapted to accommodate in male-female mating engagement the externally threaded mouth portion of a suitable container 22 having the desired liquid therein. The opposite distal end of the member 14 forms a portion 24 transverse the longitudinal axis of member 14 and has a pair of notched portions 26 each defined by a pair of opposing parallel shoulders 28, 30 communicating with a tab or wing portion 32. The notched portions 26 are in spaced apart relation and will generally correspond to the length of a suitable liquid applicator member 34 that receives the liquid from the bore 16 and holds the same for delivery to the substrate 12. The member 34 may be any suitable material, i.e., sponge — natural or synthetic, cloth, etc. In the preferred embodiment, the bore 16 when entering or communicating with the portion 24 branches out to form a plurality of minor bores or conduits **16*a* communicating with and being fed by the major bore 16. Generally, the minor bores 16*a* are perpendicular to the main bore 16 and to the member 34 while the main bore 16 is parallel thereto. A snap fitting cover portion 36 is provided to engage and cover the applicator member 34. Generally, the portion 36 is pan or tray shaped and has a pair of inwardly bent ends that engage at each end of one of the shoulders 28, on each side of the portion 26. The outer surface of the cover 36 includes over at least a portion thereof, a rigid scraper means 38, preferably having beveled side portions and a pointed end section. The means 38** may be constructed of any suitable material, i.e., rubber, plastic, etc.

Since it is obvious that numerous changes and modifications can be made in the above-described details without departing from the spirit and nature of the invention, it is to be understood that all such changes and modifications are included within the scope of the invention.

I claim:

1. A liquid applicator for use in combination with a container having an externally threaded mouth means and a quantity of liquid therein, comprising an elongated tubular member having a central main bore disposed therein in longitudinal alignment therewith, one distal end of said tubular member forming a support means of enlarged size relative to the same and being disposed transverse the longitudinal axis thereof, said support means including a plurality of minor bores therein, said minor bores communicating with and being substantially perpendicular to said main bore, said support means including a pair of winged projections along two opposing sides thereof, a porous member for receiving and retaining a quantity of liquid for subsequent application disposed along the surface of said support means, said member communicating with and being substantially perpendicular to said minor bores, said opposite distal end of said tubular member having an open mouth defining a plurality of internally disposed threads adjacent thereof, said internally disposed threads adapted to mate with said threads on said container, and cover means adapted to cover said porous member, said cover means including a rigid scraper means having beveled side portions and a pointed end section.

2. The applicator as defined in claim 1 wherein said winged projections depend from a portion of said support means and provide a pair of opposing shoulders.

3. The applicator as defined in claim 2 wherein said cover means engages said shoulders.

4. The applicator as defined in claim 1 wherein said main bore has a diameter of about ¼–1/7 of that of said tubular member.

5. The applicator as defined in claim 4 wherein said minor bores are of the same diameter as said main bore.

* * * * *